United States Patent [19]

Herring

[11] Patent Number: 5,067,526

[45] Date of Patent: Nov. 26, 1991

[54] 14 HARNESS DUAL LAYER PAPERMAKING FABRIC

[75] Inventor: Samuel H. Herring, Tallahassee, Fla.

[73] Assignee: Niagara Lockport Industries, Inc., Quincy, Fla.

[21] Appl. No.: 562,728

[22] Filed: Aug. 6, 1990

[51] Int. Cl.[5] ..... D03D 13/00

[52] U.S. Cl. ..... 139/383 A; 139/413; 162/DIG. 1

[58] Field of Search ..... 139/383 A, 425, 413; 162/DIG. 1, 348, 358

[56] References Cited

U.S. PATENT DOCUMENTS

| | | | |
|---|---|---|---|
| 4,112,982 | 9/1978 | Bugge et al. . | |
| 4,499,927 | 2/1985 | Borel . | |
| 4,564,051 | 1/1986 | Odenthal | 139/383 A |
| 4,564,052 | 1/1986 | Borel . | |
| 4,592,395 | 6/1986 | Borel . | |
| 4,709,732 | 12/1987 | Kinnunen . | |
| 4,739,803 | 4/1988 | Borel | 139/383 A |
| 4,776,373 | 10/1988 | Borel . | |
| 4,789,009 | 12/1988 | Troughton . | |
| 4,982,766 | 1/1991 | Taipale et al. | 139/383 A |
| 4,998,568 | 3/1991 | Vohringer | 139/383 A |

*Primary Examiner*—Andrew M. Falik

*Attorney, Agent, or Firm*—Lorusso & Loud

[57] ABSTRACT

A dual layer 14 harness woven papermaking fabric having an upper, or sheet, side and a lower, or machine, side is disclosed and includes a set of machine direction yarns, a first set of cross machine direction yarns extending mainly on the sheet side and a second set of cross machine direction yarns extending mainly on the machine side, both being interwoven with the machine direction yarn, with the sheet side knuckles of the machine direction yarns floating over two of the sheet side cross machine direction yarns. The interlacing of the machine direction yarns and the cross machine direction yarns includes at least one machine direction yarn interposed between the lowermost portions of each of the sheet side cross machine direction yarns and any subjacent machine side cross direction yarns, whereby overlap of adjacent cross machine direction yarns of the machine side set and the sheet side set is substantially avoided.

10 Claims, 8 Drawing Sheets

Fig. 1
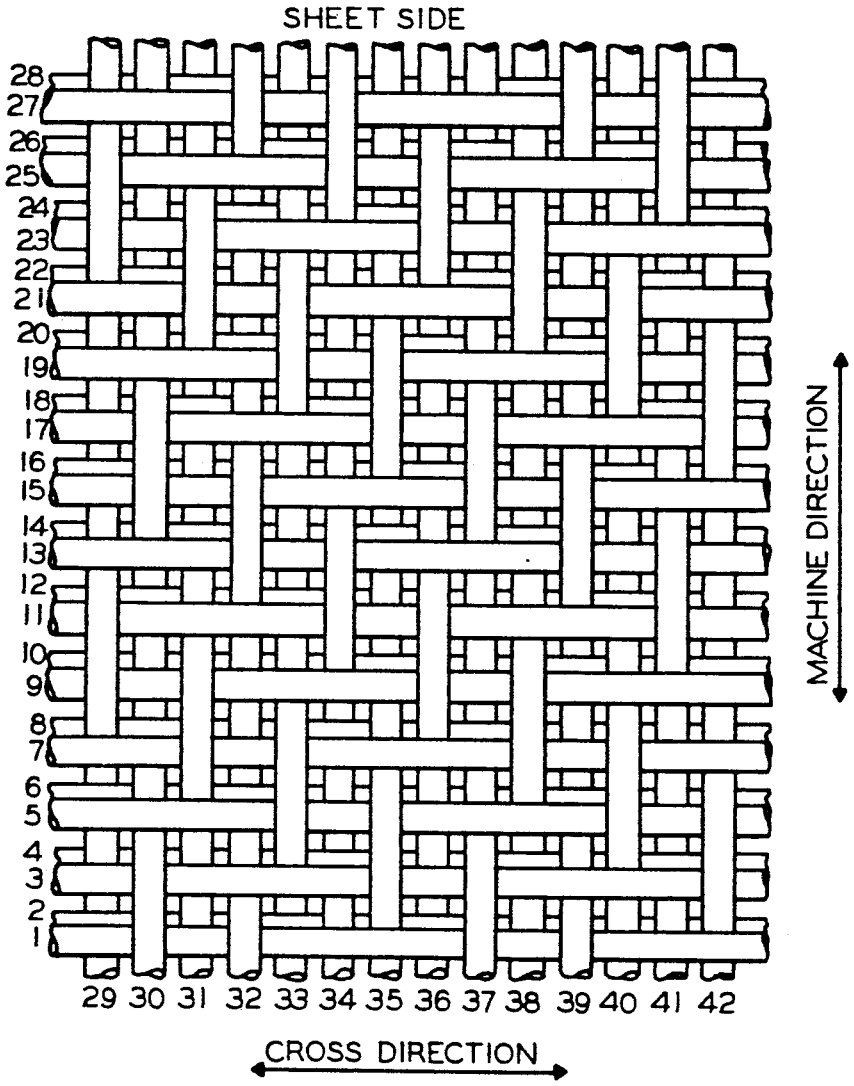
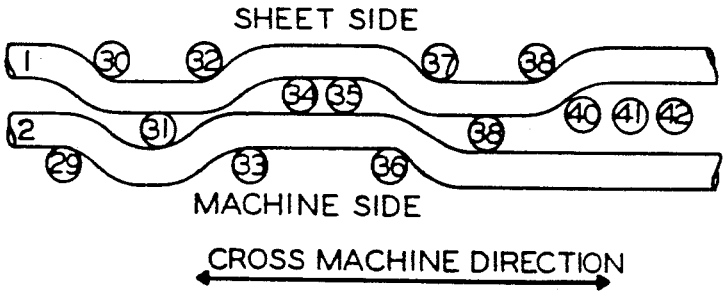
Fig. 4

14 HARNESS DUAL LAYER PAPERMAKING FABRIC

BACKGROUND OF THE INVENTION

This invention relates generally to papermaking fabrics and more particularly to dual layer weaves that are typically used as forming fabrics in papermaking and related machines. Such fabrics, when used in the forming step of the papermaking process, receive the slurry of the cellulosic fibers and form extended webs of the paper as moisture is withdrawn by vacuum boxes beneath the fabric drawing out the water. Accordingly, a desirable feature for such fabrics is high air permeability, a feature that may be enhanced by a dual layer weave. Papermaking fabrics having dual layer weaves include two layers of yarns extending in the cross machine direction interwoven with a single set of machine direction yarns. The respective yarns of the two cross direction layers generally are stacked with a yarn of one layer being directly above a corresponding yarn of the other layer or set. Thus, there are generally about an equal number of cross direction yarns in each layer.

Papermaking fabrics conventionally are woven either flat or endless. A flat woven fabric is woven in a single sheet with the warp yarns extending in the machine direction and the weft yarns extending in the cross machine direction. After weaving is completed the opposed ends of the warp filaments, and thus of the fabric sheets, are joined together to form a continuous belt. Endless woven fabrics are woven with the weft yarns extending in the machine direction and the warp yarns extending in the cross machine direction, with the fabric being woven as an endless loop that may not require any seam.

A goal of such papermaking fabrics has always been to increase the durability and wear resistance of the fabric. Another goal has been to improve the air permeability to facilitate faster removal of water to thus speed the formation of paper on the fabric. Increased wear resistance is one of the benefits of a dual layer fabric, particularly one in which the cross direction yarns on the machine side have long floats under a number of machine direction yarns. However, where improved wear resistance has been achieved with such a weave, there frequently has been a less than desired air permeability for removal of water.

SUMMARY OF THE INVENTION

In order to overcome the disadvantages of the prior art papermaking fabrics, the present invention provides a fabric for use on papermaking machines formed of a dual layer, 14 harness weave having an upper, or sheet, side and a lower, or machine, side. This woven fabric includes a set of machine direction yarns, a first set of cross machine direction yarns extending mainly on the sheet side and interlaced with the set of machine direction yarns such that each sheet side knuckle of the machine direction yarns floats over two of the sheet side cross machine direction yarns and a second set of cross machine direction yarns extending mainly on the machine side and interlaced with the set of machine direction yarns. The interlacing of the machine direction yarns and the cross machine direction yarns includes at least one machine direction yarn interposed between the lowermost portions of each sheet side cross machine direction yarn and any subjacent machine side cross direction yarn, whereby overlap of the adjacent cross machine direction yarns of the machine side set and the sheet side set is substantially avoided.

BRIEF DESCRIPTION OF THE DRAWINGS

Two particularly preferred embodiments of the papermaking fabric of the present invention are described in detail below in connection with the drawings in which:

FIG. 1 is a sheet side plan view on enlarged scale of a section of a first embodiment of the fabric;

FIG. 4 is an end view of the fabric section of FIG. 1;

FIG. 8 is an end view of the fabric of FIG. 5 illustrating the interlacing of the two indicated cross machine direction yarns with machine direction yarns.

DETAILED DESCRIPTION OF PREFERRED EMBODIMENTS

A first preferred embodiment of the fabric of the present invention is illustrated in FIGS. 1–4. FIG. 1 is plan view of a portion of the sheet, or upper, side of the weave of this embodiment, with each of the yarns individually numbered for reference with corresponding FIGS. 2–4. The weave provides a 14 harness high density double layer fabric. The fabric of this invention suitably may be woven from monofilament yarns of synthetic material conventionally used in such fabrics, with such materials including copolymers, polyamides, polyesters and acrylics. In a preferred example of this weave the fabric is woven as a 136 by 108 mesh of 0.17 mm machine direction yarns and cross machine direction yarns of 0.22 mm to 0.28 mm and is heat set to a mesh of 152 by 104 having a caliper of 0.037 in.

Figure 2:
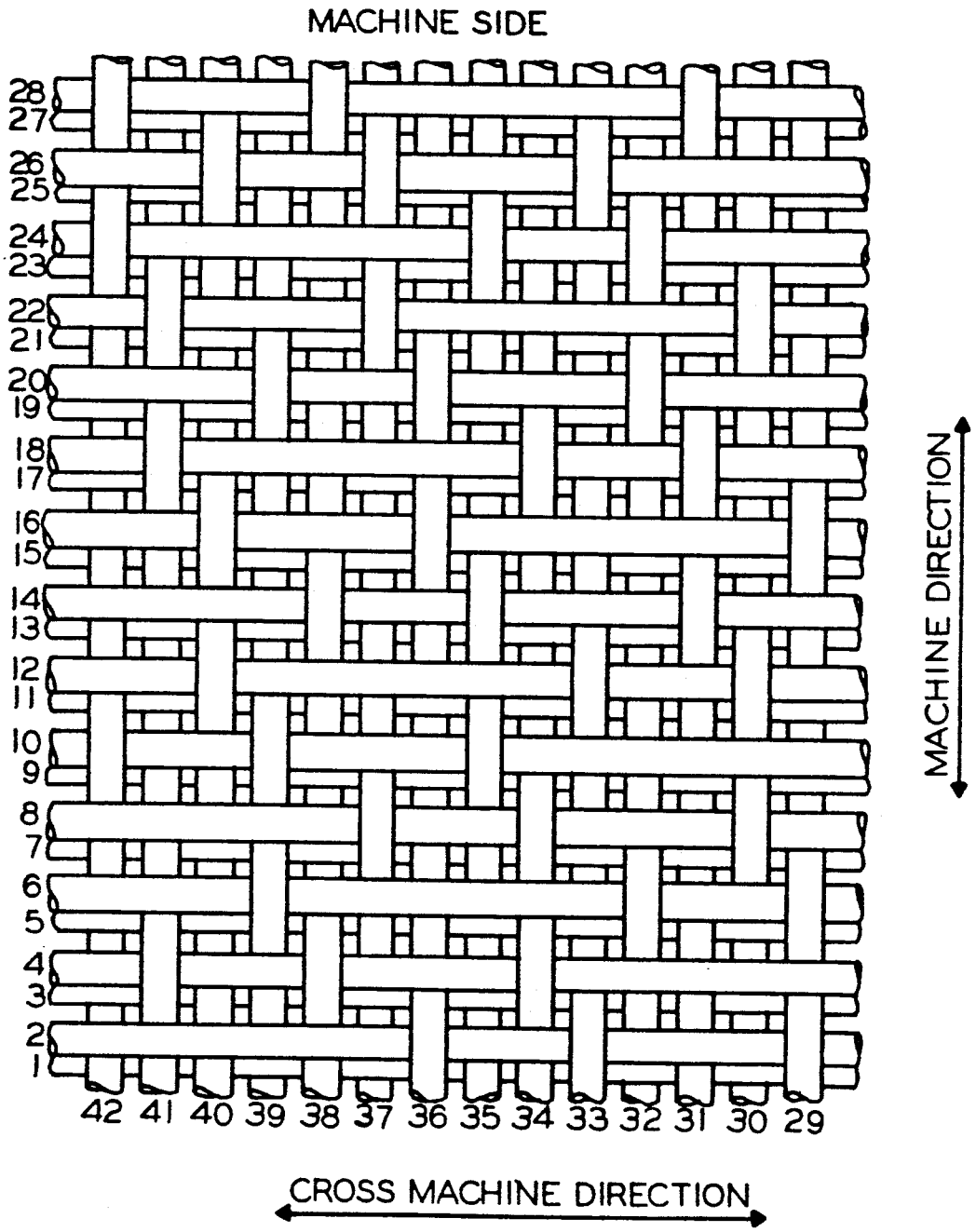
FIG. 2 is a machine side view of the fabric of FIG. 1.
Figure 3:
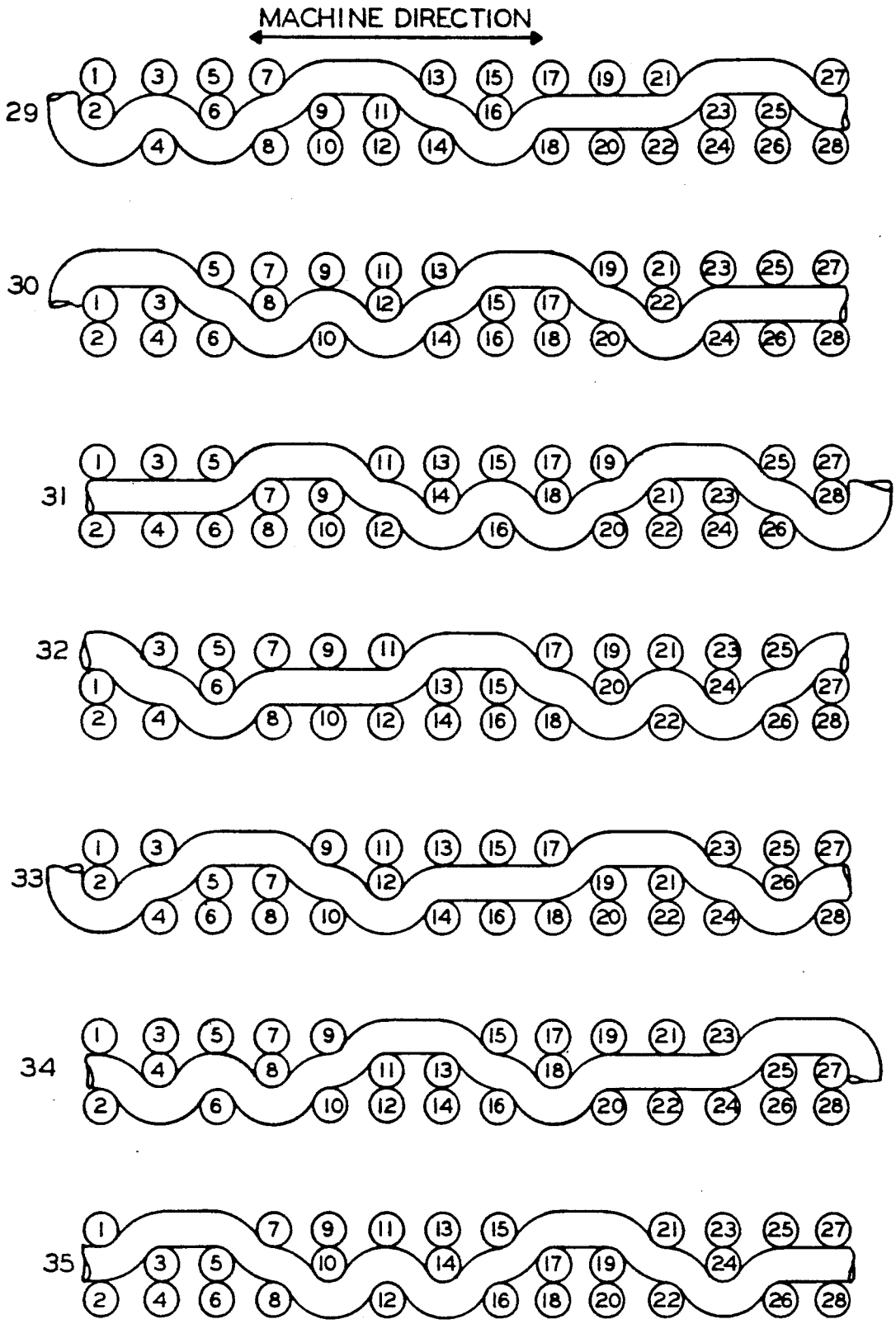
FIGS. 3 and 3*a* are sectional views through the fabric of FIG. 1 taken along the machine direction to illustrate the interlacing patterns of the indicated machine direction yarns.
Figure 3A:
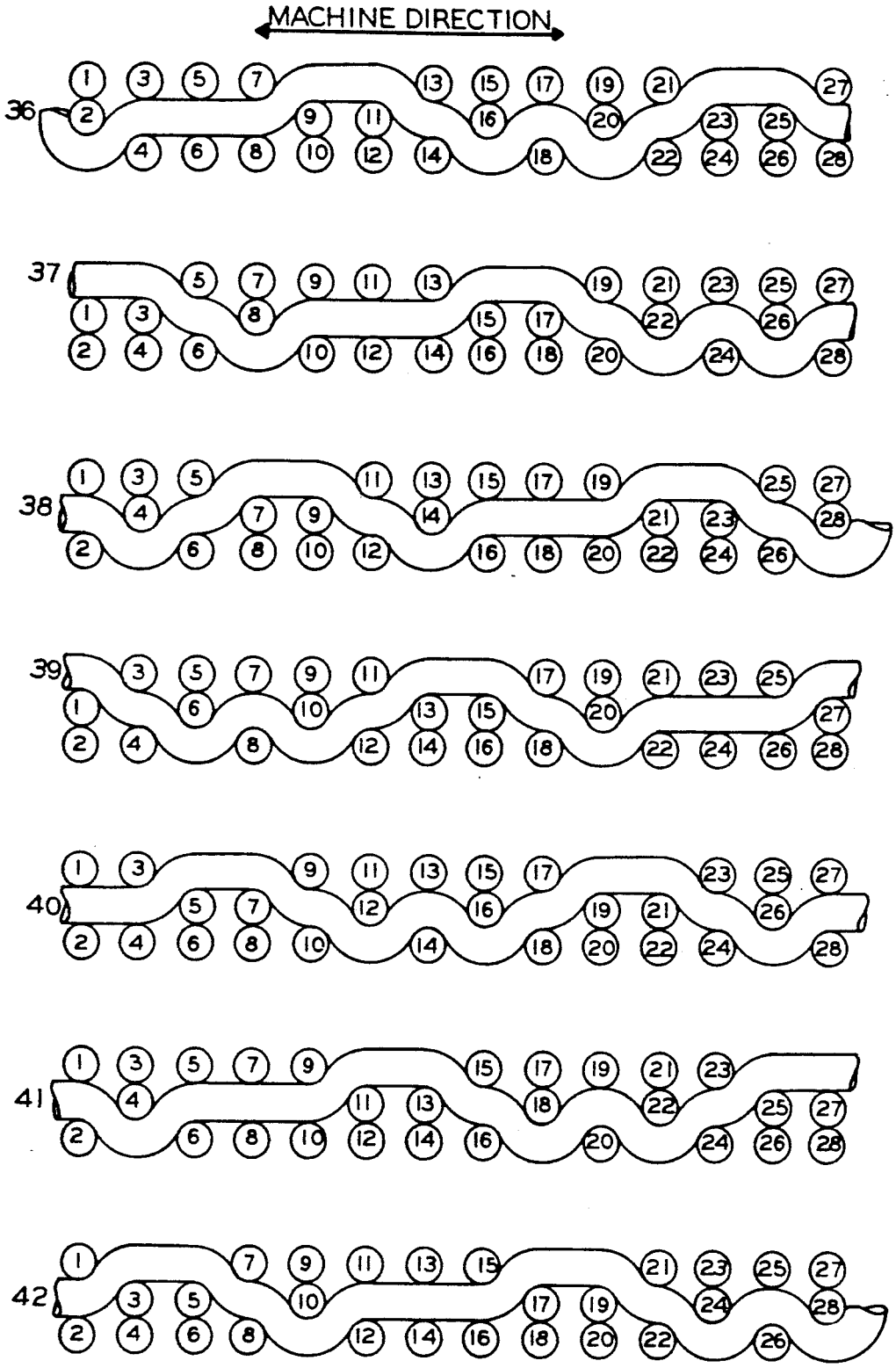

As shown in FIGS. 3 and 3*a* the respective pairs of cross machine direction yarns 1–28 are generally vertically stacked, placing them one above another. In FIG. 1 they are illustrated as being slightly displaced for the purpose of clarifying the illustration. FIGS. 3 and 3*a* illustrate the respective interweavings of the machine direction yarns 29–42 with the respective cross machine direction yarns 1–28, thus illustrating one complete weave repeat in each direction. The odd numbered cross machine direction yarns 1–27 comprise a first set of such yarns extending mainly on the sheet side and interlaced with the set of machine direction yarns 29–42 so that each sheet side knuckle of the machine direction yarns floats over two of the sheet side cross machine direction yarns. The even numbered cross machine direction yarns 2–28 in these illustrations comprise a second set of such yarns, extending mainly on the machine side and interlaced with the set of machine direction yarns. As is shown in FIG. 3, each machine direction yarn, e.g. yarn 30, in each weave repeat passes above both layers of the cross machine direction yarns for two yarn counts 1–4, then goes between the layers for one yarn count, then under both layers of cross direction yarns for one yarn count 7, 8, then back between the layers for one yarn count 9, 10, again under both layers for one more yarn count 11, 12 and again between the layers for one more yarn count 13, 14. This machine direction yarn 30 then passes above both cross machine direction layers for two yarn counts 15–18, then between the two layers for one count 19, 20, under both layers for one yarn count 21, 22 and between the two layers for three yarn counts 23–28 before repeating the pattern of interlacing. Each of the other machine direction yarns 29 and 31–42 follows the same pattern of interlacing with the cross machine direction yarns, albeit shifted, as do their adjacent such machine direction yarns.

For convenience of reference and explanation, the sheet side of the fabric may be considered an upper surface and the machine side of the fabric may be considered a lower surface of the fabric. Thus, in the end view of FIG. 4 the interlacing of the machine direction yarns and the cross machine direction yarns may be seen to include at least one such machine direction yarn 31 or 38 interposed between the lowermost portion of each cross machine direction yarn 1 of the first layer and any subjacent cross machine direction yarn 2 of the second layer. In this manner, overlap of adjacent cross machine direction yarns, such as yarns 1 and 2 in FIG. 4, may be substantially avoided. Also, as shown in FIG. 4, the float of each cross machine direction yarn, such as yarn 2, in the machine side layer is under no more than six machine direction yarns, such as yarns 37–42, before passing over a machine direction yarn, such as yarn 29.

With the weave of this invention no two machine direction yarns within any single weave repeat of the cross machine direction yarns float between the same three pairs of such cross machine direction yarns in the two respective sets of the cross machine direction yarns. However, each machine direction yarn follows the same pattern of interlacing with the cross machine direction yarns as the other machine direction yarns, albeit offset, as illustrated in the figures.

As shown in FIGS. 3 and 3*a* the pattern of interlacing of each machine direction yarn with the cross machine direction yarns includes a double interlace with yarns of one of the sets of cross machine direction yarns in each weave repeat of that machine direction yarn. In this preferred embodiment the double interlace by the machine direction yarns is with the machine side set of cross machine direction yarns. For example, the double interlace of machine direction yarn 29 is with cross machine direction yarns 2, 4, 6 and 8 of the machine side set of those cross machine direction yarns. This double interlace provides two adjacent machine direction yarn knuckles that are positioned together to crimp the larger cross machine direction yarns and provide better wear capabilities for the fabric in use. Another significant advantage of the weave of this first preferred embodiment is the surprisingly high air permeability as measured in standardized tests conventionally applied to forming fabrics. While comparable fabrics, such as those disclosed in U.S. Pat. No. 4,709,732 may exhibit, in such standardized tests, an air permeability of 510–520 $ft^3$/min, the weave of this first preferred embodiment provides an air permeability of not less than about 550 $ft^3$/min, and in those standardized tests has demonstrated an air permeability of over 580 $ft^3$/min.

Figure 6:
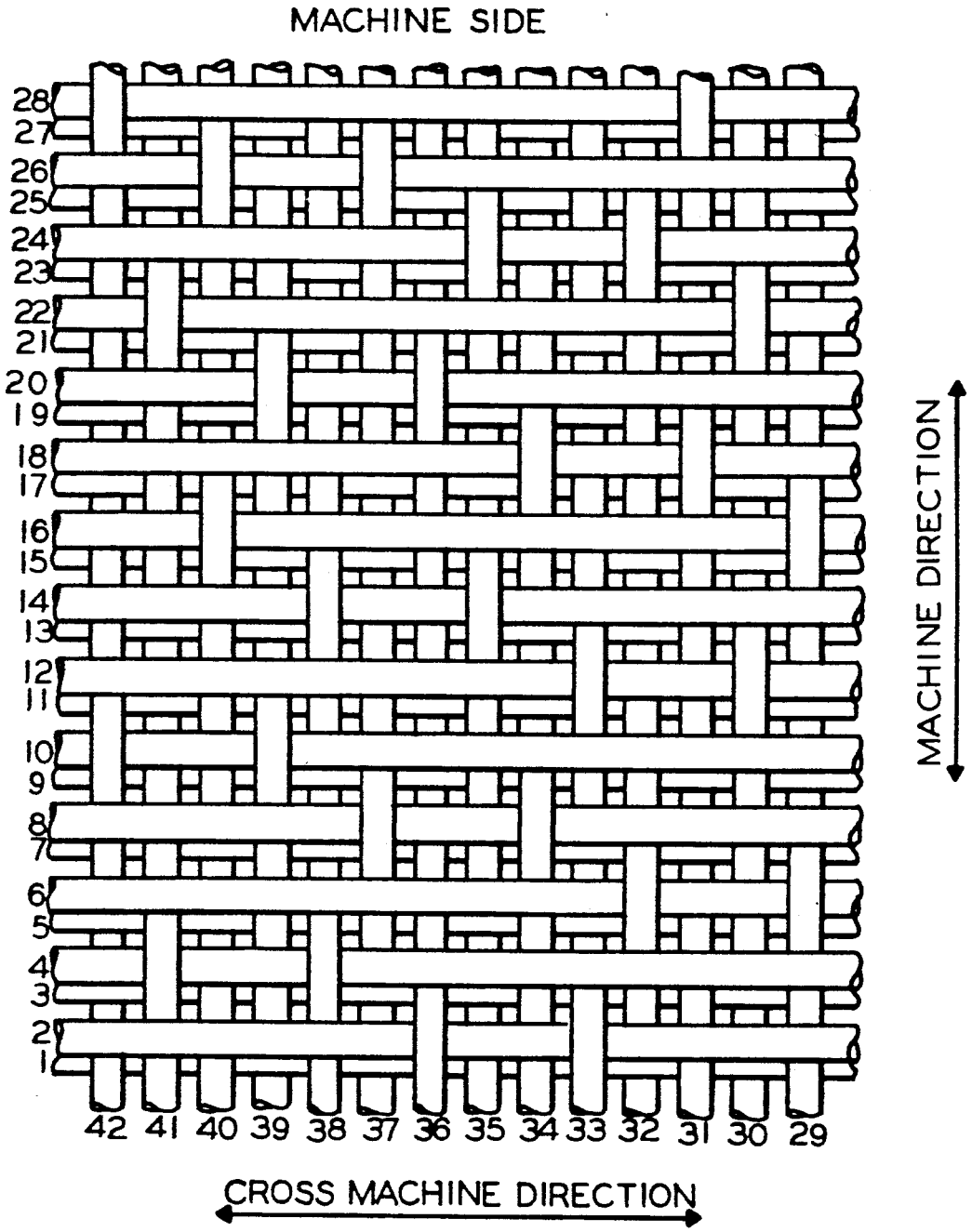
FIG. 6 is a machine side view of the fabric of FIG. 5.
Figure 7:
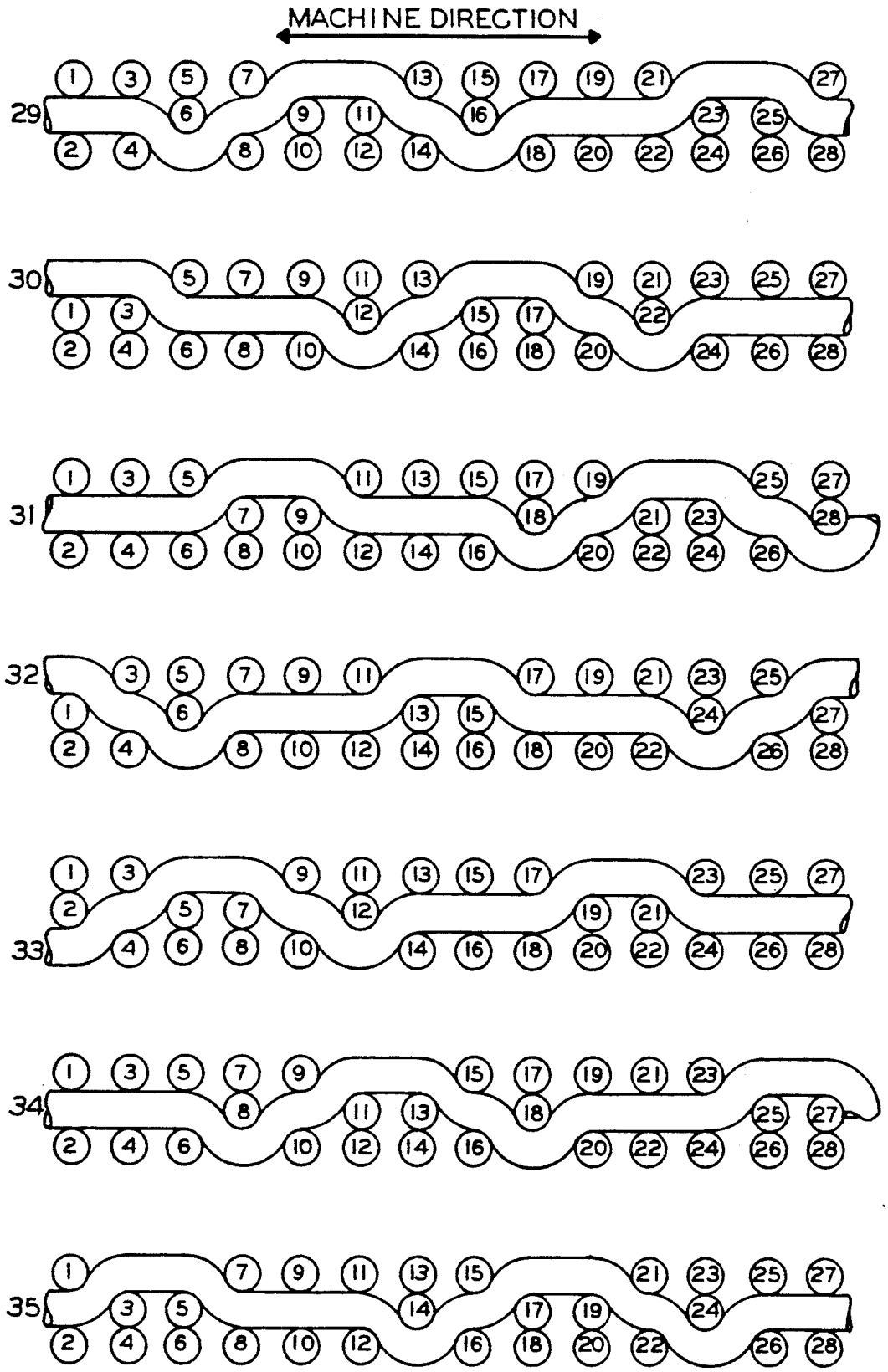
FIGS. 7 and 7*a* are sectional views through the fabric taken along the machine direction to illustrate the interlacing patterns of the indicated machine direction yarns.
Figure 7A:
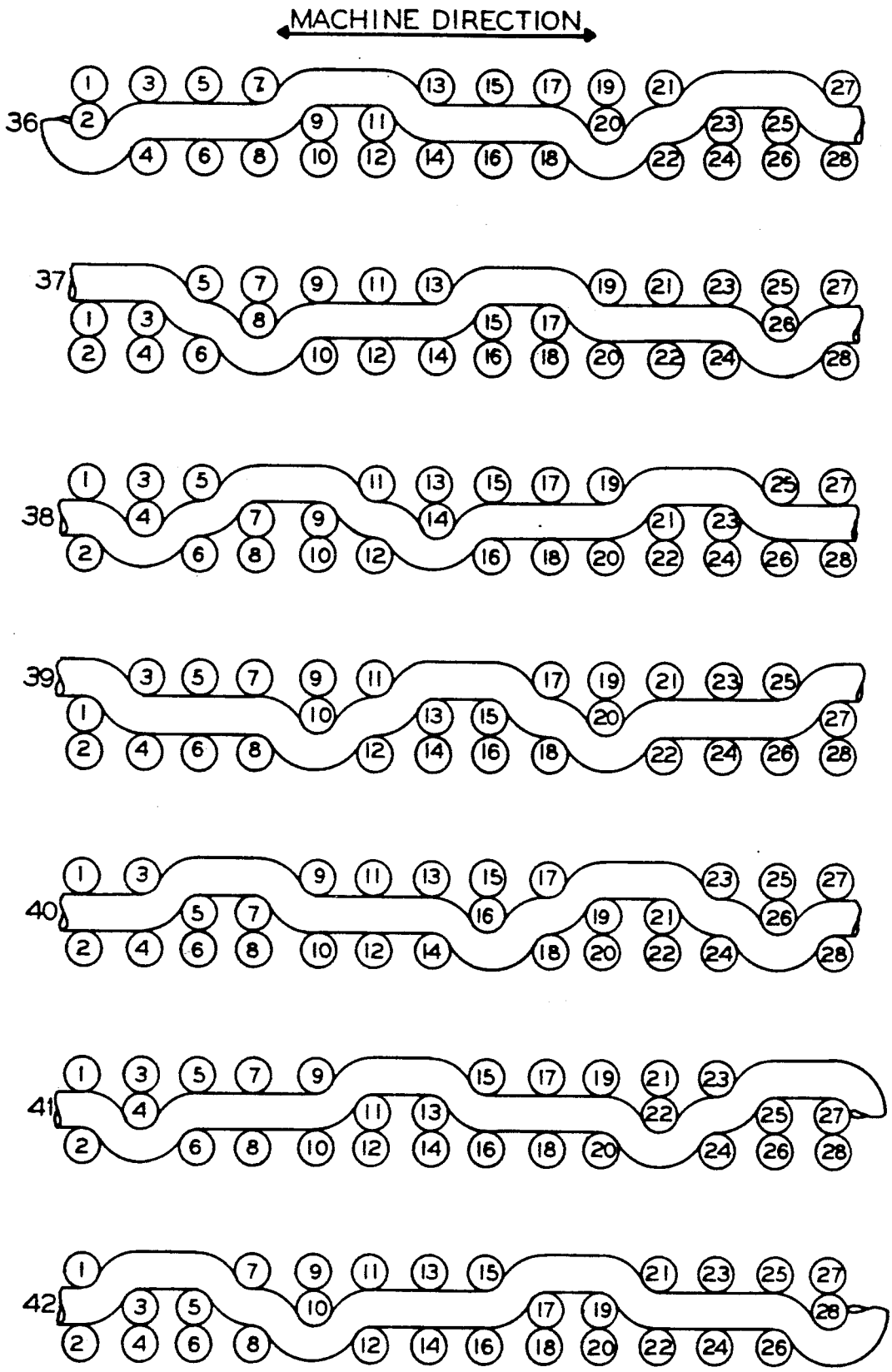
Figure 5:
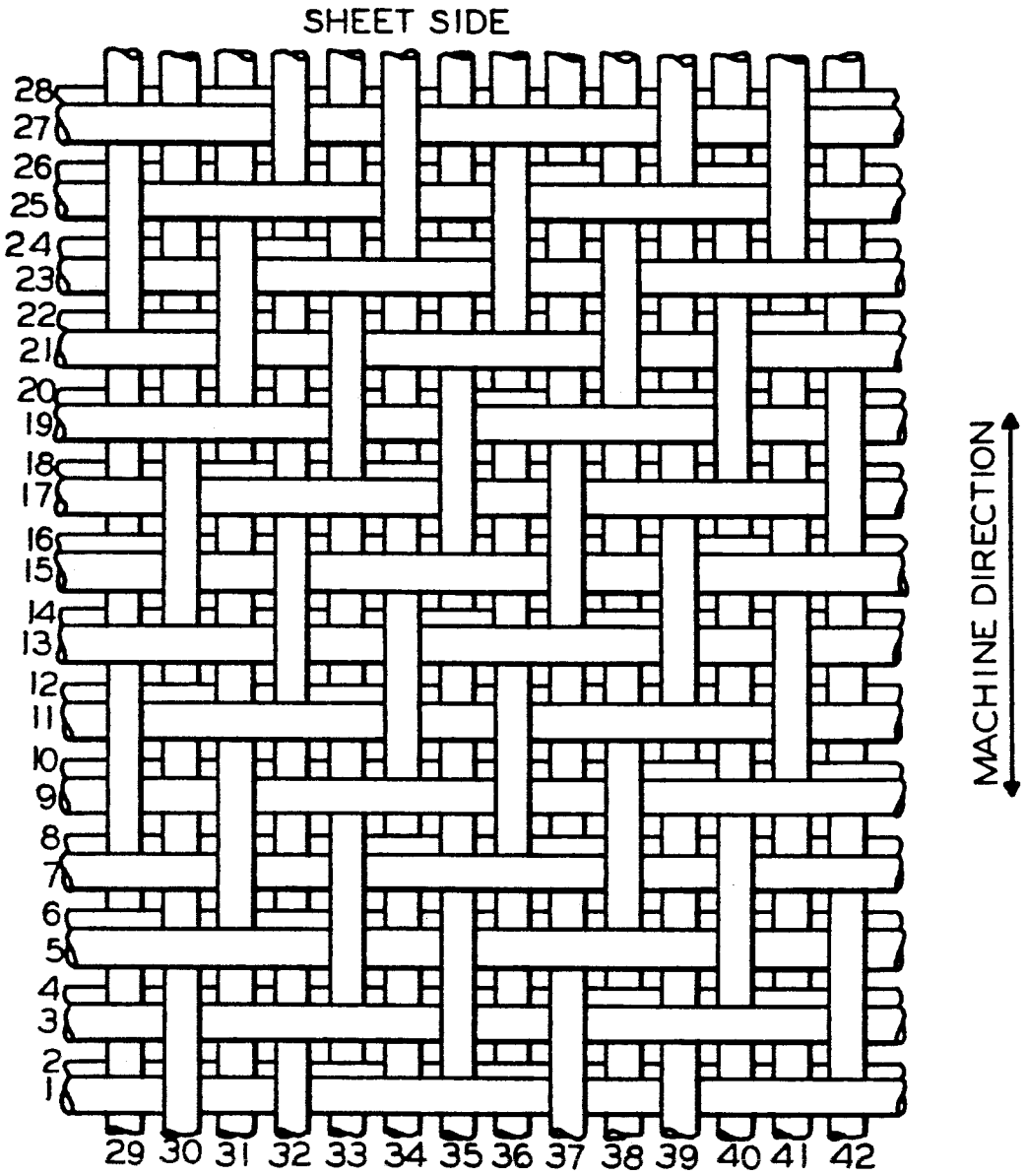
FIG. 5 is a sheet side plan view on an enlarged scale of a section of a second preferred embodiment of the fabric of the present invention.
Figure 6:
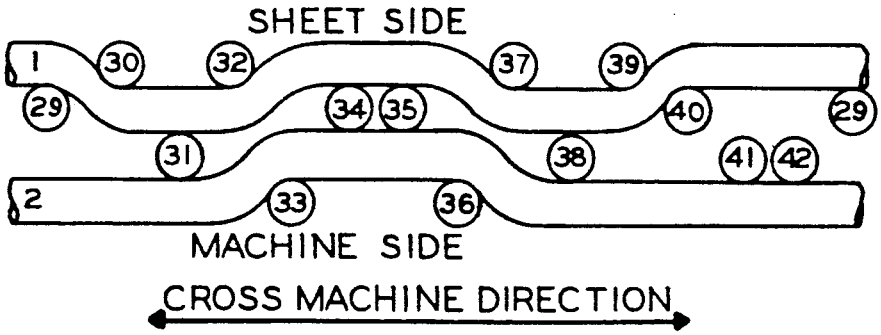

A second preferred embodiment of the fabric of this invention is shown in FIGS. 5–8, with FIG. 5 illustrating a plan view of a portion of the sheet side of the fabric of this second embodiment, and FIG. 6 illustrating a plan view of a portion of the machine side of that same weave. FIGS. 7 and 7*a* illustrate the interlacing of the various machine direction yarns with the respective layers of cross machine direction yarns in FIGS. 5 and 6, corresponding generally to FIGS. 3 and 3*a* of the first embodiment. FIG. 8 of this embodiment corresponds generally to FIG. 4 of the first embodiment, illustrating the interlacing of cross machine direction yarns 1 and 2 with one repeat of the machine direction yarns 29–42.

The weave of this second embodiment bears many similarities to the first embodiment of FIGS. 1–4 including the respective first set of odd numbered cross machine direction yarns 1–27 extending mainly on the sheet side and second set of even numbered cross machine direction yarns 2–28 extending mainly on the machine side, with both sets of cross machine direction yarns interlaced with the machine direction yarns. Also, both weaves have the sheet side knuckles of the machine direction yarns each floating over two of the sheet side cross machine direction yarns with interlacing of the machine direction yarns and the cross machine direction yarns including at least one machine direction yarn interposed between the lowermost portions of each of the sheet side cross machine direction yarn and any subjacent machine side cross machine direction yarn to substantially avoid overlap of adjacent cross machine direction yarns of the first and second sets. As shown in FIG. 5, the float of the interlacing pattern of each machine side cross direction yarn extends under no more than 10 of the machine direction yarns, as contrasted to the corresponding knuckles of the first embodiment extending under only six of the machine direction yarns.

FIGS. 7 and 7*a* illustrate another distinction between the two embodiments. Specifically, the pattern of interlacing of each machine direction yarn 29–42 with respect to the various cross machine direction yarns in this embodiment is symmetrical about each sheet side float of that machine direction yarn. For example, the path of machine direction yarn 32 in FIG. 7 is clearly seen to be symmetrical about the float in which that yarn 32 extends over cross machine direction yarns 13 and 15 to form a sheet side float. Likewise, the symmetry of the other portion of the weave can be seen with respect to machine direction yarn 39, which likewise has a pattern of interlacing with the cross machine direction yarns that is symmetrical about the knuckle formed over yarns 13 and 15 of the sheet side set of those cross machine direction yarns. The same applies to every other machine direction yarn, these two examples having been chosen simply for the clarity of their illustrations.

This second embodiment, in a manner similar to that of the first, has been found also to have unusually high air permeability. In an example of this weave, woven in a mesh of 136 by 108 and heat set as a 152 by 104 mesh formed of 0.17 mm machine direction monofilament yarns and cross machine direction yarns of 0.22 to 0.28 mm yielding a caliper of 0.037 in., this weave has demonstrated an air permeability of 589 $ft^3$/min in the standardized tests. This surprisingly high air permeability provides for rapid dewatering of the web formed on the sheet side of the fabric when operated in a papermaking machine. This provides a significant additional advantage for the fabric of this invention over those conventionally known.

While two closely related weaves have been described in detail above as illustrating preferred embodiments of the present invention, it is to be recognized that numerous other variations and modifications of the weave of this invention, all within the scope of this invention, will readily occur to those skilled in the art. Accordingly, the scope of the invention is to be limited solely by the claims appended hereto.

What is claimed is:

1. A fabric for use on a papermaking machine, comprising a dual layer, fourteen harness woven fabric having an upper, or sheet, side and a lower, or machine, side and further comprising a set of machine direction yarns;

a first set of cross machine direction yarns forming knuckles with said machine direction yarns and extending mainly on said sheet side and interlaced with said set of machine direction yarns such that each sheet side knuckle of said machine direction yarns floats over two of the sheet side cross machine direction yarns;

a second set of cross machine direction yarns extending mainly on said machine side and interlaced with said set of machine direction yarns;

said interlacing of said machine direction yarns and said cross machine direction yarns including at least one said machine direction yarn interposed between each lowermost portion of each said sheet side cross machine direction yarn and any subjacent said machine side cross machine direction yarns, whereby overlap of adjacent cross machine direction yarns of said machine side set and said sheet side set is substantially avoided.

2. The papermaking fabric of claim 1 wherein said fabric has an air permeability of not less than about 550 cubic feet per minute.

3. The papermaking fabric of claim 1 wherein no two said machine direction yarns within any single weave repeat of said cross machine direction yarns float between the same three pairs of said cross machine direction yarns in the two said sets of cross machine direction yarns.

4. The papermaking fabric of claim 1 wherein each said machine direction yarn follows the same pattern of interlacing with said cross machine direction yarns as adjacent said machine direction yarns.

5. The papermaking fabric of claim 1 further comprising a float of the interlacing pattern of each said machine side cross machine direction yarns being under no more than ten said machine direction yarns.

6. The papermaking fabric of claim 5 wherein said float of each said machine side cross machine direction yarn is under no more than six said machine direction yarns.

7. The papermaking fabric of claim 1 wherein the pattern of interlacing of each said machine direction yarn with said cross machine direction yarns is symmetrical about said sheet side float of said machine direction yarn.

8. The papermaking fabric of claim 1 wherein the pattern of interlacing of each said machine direction yarn with said cross machine direction yarns includes a double interlace with yarns of one said set of cross machine direction yarns in each weave repeat of said machine direction yarn.

9. The papermaking fabric of claim 8 wherein said double interlace by said machine direction yarn is with said machine side set of said cross machine direction yarns.

10. The papermaking fabric of claim 1 wherein said papermaking fabric is a forming fabric.

* * * * *